United States Patent [19]

Schiavi

[11] Patent Number: 5,069,125

[45] Date of Patent: Dec. 3, 1991

[54] ROTARY GRAVURE PRINTING MACHINE

[75] Inventor: Vito Schiavi, Piacenza, Italy

[73] Assignee: Schiavi Cesare Costruzioni Meccaniche S.p.A., Milan, Italy

[21] Appl. No.: 407,917

[22] Filed: Sep. 15, 1989

[30] Foreign Application Priority Data

Oct. 5, 1988 [IT] Italy ..... 40145 A/88

[51] Int. Cl.[5] ..... B41F 9/18

[52] U.S. Cl. ..... 101/152; 101/218; 101/247

[58] Field of Search ..... 101/152, 153, 180, 181, 101/182, 183, 184, 139, 137, 140, 143, 145, 191, 192, 209, 228, 247

[56] References Cited

U.S. PATENT DOCUMENTS

| | | | |
|---|---|---|---|
| 2,335,010 | 11/1943 | Huck | 101/184 |
| 2,419,403 | 4/1947 | Horton et al. | 101/184 |
| 2,746,386 | 5/1956 | Bamford | 101/153 |
| 3,892,178 | 7/1975 | Staamann | 101/182 |
| 4,074,626 | 2/1978 | Werner | 101/182 |
| 4,108,067 | 8/1978 | Werner | 101/182 |
| 4,480,543 | 11/1984 | Hechler | 101/181 |
| 4,541,337 | 9/1985 | Schaul | 101/181 |

FOREIGN PATENT DOCUMENTS

| | | | |
|---|---|---|---|
| 2353563 | 3/1972 | Fed. Rep. of Germany | 101/153 |

*Primary Examiner*—Edgar S. Burr
*Assistant Examiner*—Joseph R. Keating
*Attorney, Agent, or Firm*—Hoffmann & Baron

[57] ABSTRACT

The machine substantially comprises two bays (9, 9*a*) accommodating the rotorgravure cylinders, either one of which is approachable from alongside by a trolley (4, 4*a*) carrying the print cylinder (6, 6*a*) and individually accessible regardless of whether the remaining bay is already occupied by a trolley and cylinder or not; each bay is served by its own impression cylinder (10, 10*a*) and doctor (8, 8*a*), which operate in conjunction with each replacement print cylinder brought in on the trolley. The speed with which print cylinders can be changed over and recommence operation is considerably enhanced by the design of the improved machine.

3 Claims, 2 Drawing Sheets

ROTARY GRAVURE PRINTING MACHINE

BACKGROUND OF THE INVENTION

The present invention relates to an improved rotary machine for gravure printing.

Conventionally, rotogravure machines comprise a number of assemblies, each of which printing in one given color. Each such assembly comprises a print cylinder, bearing the image to be reproduced, which rotates with its bottom part immersed in a bath of ink in such a way that the ink is picked up and carried to the point of transfer, surplus ink being removed from the cylinder by a blade (the doctor); also forming part of the assembly is an impression cylinder, mounted usually above the print cylinder, by which a web of material running between the two cylinders is urged against the inked surface of the print cylinder.

In operation, the web is fed between the print and impression cylinders of each successive assembly in this manner, receiving one component color part of the composite image at each assembly as it passes through the machine.

With each printing run completed, preparation for another (with a different image) clearly involves changing over all the print cylinders.

Such a procedure is notably time-consuming, as the print cylinder has to be lifted from its bearings and the ink bath from its support, and replaced by the cylinder and bath needed for the next run, whereupon the new print cylinder must be correctly positioned, as also must be the doctor blade which removes surplus ink. Needless to say, the change procedure must be effected for each single station. Furthermore, the procedure outlined is rendered difficult by the fact that the print cylinder and ink bath are notably cumbersome and heavy.

With changeover in progress, the machine obviously must remain at a standstill, of duration dependent upon the number of individual cylinder assemblies; in effect, the interruption generally will be a matter of hours, and given the high purchase price of rotogravure equipment, every stoppage represents an increase in overheads which, in practice, denies cost-effective operation in the case of small jobs; at all events, down time will constitute a part of the costs in any contract undertaken, and persons skilled in the art know full well that where rotary printing equipment is involved, such costs run into hundreds of dollars per hour.

For some time now, the operation of changing over print cylinders and ink baths has been speeded up by the use of trolleys. Each cylinder and ink bath unit is carried by a relative trolley that can be positioned in the relative print station, thus facilitating set-up. The standard practice is to utilize two trolleys per station, such that while one trolley remains with the machine, in readiness for removal of the print cylinder and ink bath on completion of the run, the spare trolley can be equipped with a new cylinder and ink supply with which to replace the trolley removed.

With this arrangement, on completion of the run, the one cylinder and bath unit can be distanced from the machine using the first trolley, and the replacement unit moved into position in the machine using the second trolley; the replacement trolley having been thus brought into the machine, it remains to raise the cylinder and bath into the correct position, together with all the ancillary components.

Even with this method, the time needed to effect a changeover between jobs will never be less than two or three hours, especially where the rotary machine incorporates a significant number of stations. Accordingly, the object of the invention is to overcome the drawbacks described above by providing a rotogravure machine in which the time required to replace print cylinders is markedly reduced.

SUMMARY OF THE INVENTION

The stated object, and other objects besides, are realized with an improved rotary machine according to the invention claims, which, as with machines of conventional embodiment, comprises a cylinder bay, an impression cylinder by which a web of material is urged onto the print cylinder during operation, and a doctor; in addition, the machine disclosed comprises a second bay that remains accessible even when the first bay is occupied by a trolley and relative print cylinder, a second impression cylinder located in the second bay, by which the web is urged against the print cylinder of the second bay, and a second doctor.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
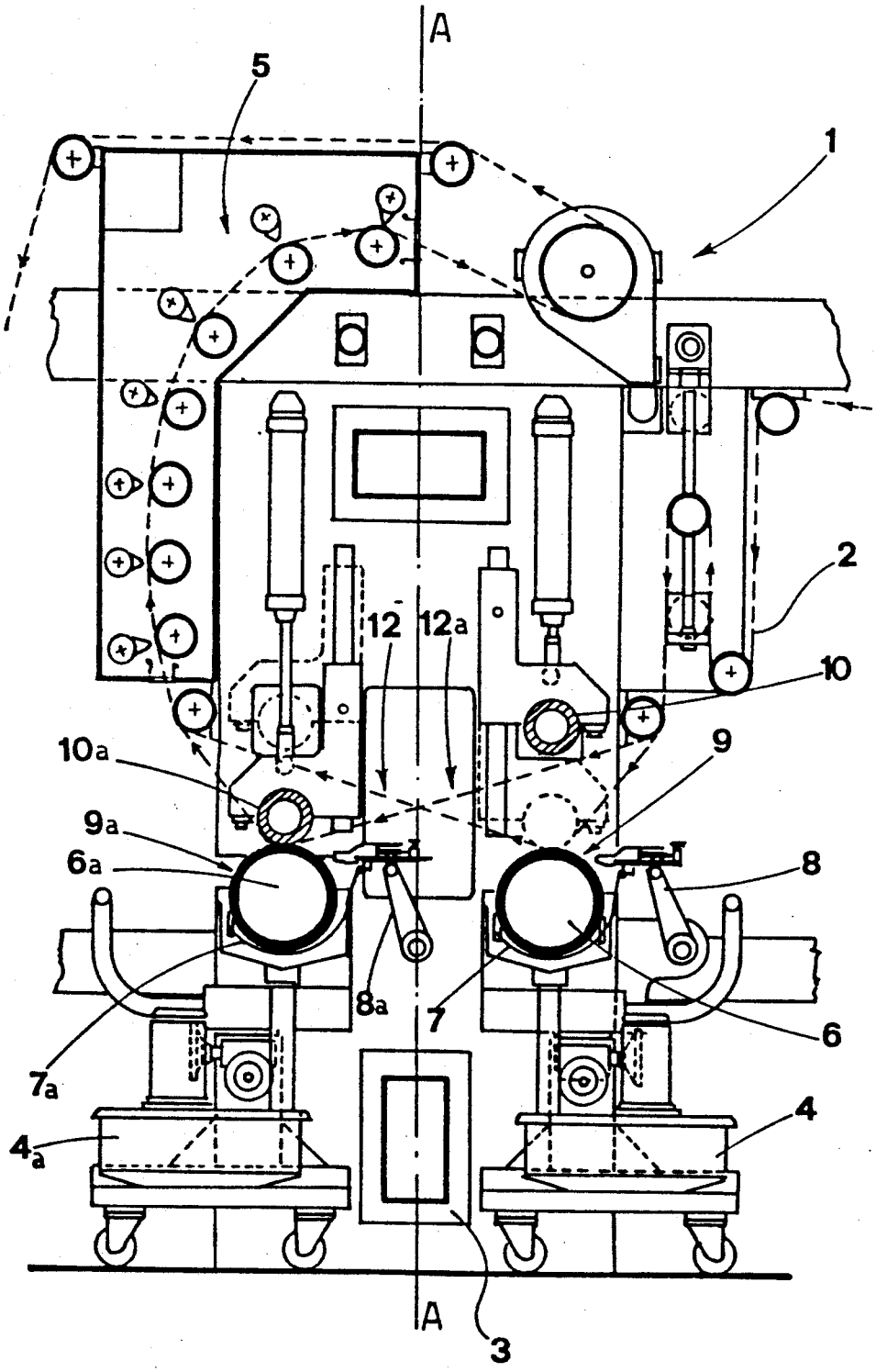
FIG. 1 illustrates a print station of the machine disclosed, viewed in side elevation with certain parts omitted better to reveal others.
Figure 2:
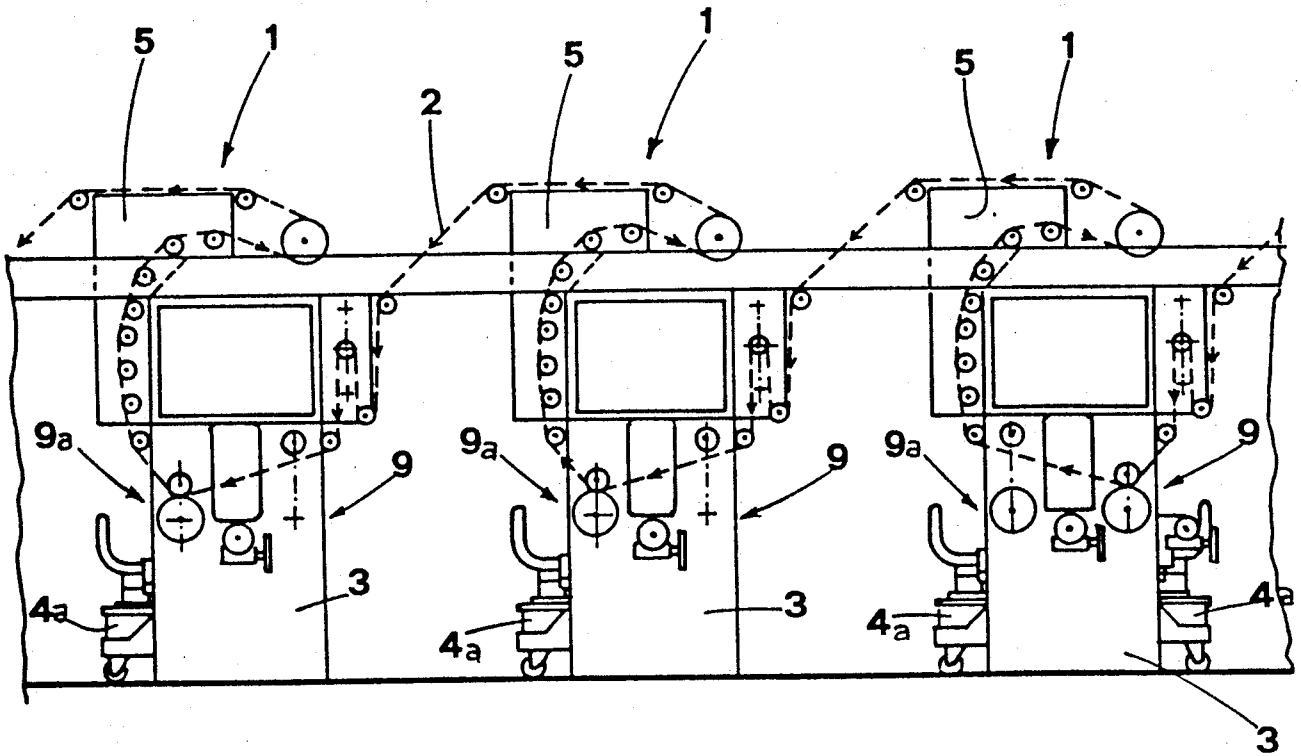
FIG. 2 is a schematic representation of several print stations forming part of the rotary machine disclosed, showing the route followed by the web.

The rotary machine comprises a plurality of print assemblies or stations 1, each of which reproducing in one color; 2 denotes a web of material destined to receive the printed image, e.g. paper, plastic, fabric etc., which passes from assembly to assembly receiving a component color part of the composite image at each one.

3 denotes a frame serving to support the various ancillary devices used in the printing process, which are conventional in embodiment; the top part of the frame carries guide rollers for the web, and a drying device 5 also of conventional embodiment. Each print cylinder assembly is encompassed by a gantry type structure disposed transversely to the path of the web 2. The lower part of the structure occupied by the print assembly affords two openings disposed symmetrically on either side of a median vertical plane A—A; each opening serves to admit a trolley **4-4*a* carrying a print cylinder 6-6*a* and an ink bath 7-7*a*, which can thus be positioned beneath the gantry structure, and coincides with a bay 9-9*a* by which the cylinder 6-6*a*** is accommodated.

The methods by which a print cylinder is connected up to the bay are conventional, as also are the drive systems by which it is operated.

More exactly, each print station comprises a first bay 9 and a second bay **9*a***, into each one of which a print cylinder and the relative ink bath can be fitted regardless of whether the remaining bay is occupied by a cylinder and bath, and irrespective of whether or not the machine is in operation.

Each bay is provided with a respective impression cylinder, i.e. first 10 and second **10*a***, carried by the gantry structure and serving to keep the web pressed against the respective print cylinder when in operation.

Means are provided by which to raise and lower the impression cylinders, and to adjust their operating pressure, which are of conventional embodiment.

The station also comprises first and second doctor blades 8 and 8*a*, each occupying a relative bay 9 and 9*a* and mounted to the structure of the machine.

It will be observed that, if the assembly of single components illustrated, comprising print cylinder, ink vessel, impression cylinder and doctor may be considered as a discrete section of the rotary printing machine, then that section is identical in all respects to the equivalent section of a machine embraced by the art, and operates in exactly the same manner; the essential feature distinguishing the improved machine from conventional machines is that it comprises two distinct sections per print station, capable of operating in alternation one with the other and of being prepared individually for operation, independently of whether the other section happens to be printing or not.

Similarly, the trolleys carrying the print cylinder and ink bath units are identical to those used with conventional machines.

Operation of the improved rotary machine will now be described.

Supposing that the section currently in operation is the left hand section as seen in FIG. 1, i.e. that denoted by the 'a'-suffixed reference numbers, the route followed by the web of material will be that denoted 12*a* and the position of the impression cylinders 10-10*a* as illustrated in bold line.

With the machine running, a trolley 4 can be moved into the right hand section, in such a way as to permit of positioning the relative print cylinder 6 and ink bath 7 in the first bay 9 in readiness for operation; similarly, the relative doctor 8 can be adjusted, still with the machine running.

These steps having been accomplished, the right hand section is practically ready to run, requiring no more than to lower the impression cylinder 10. As the left hand section terminates operation, it suffices simply to raise the relative impression cylinder 10*a* and lower the right hand cylinder 10 (shown in phantom line) into position; accordingly, the web 2 (which absolutely must not be broken) will now take up the route denoted 12, and the machine is ready to recommence printing.

It will be immediately apparent that, with such an arrangement, down time between production runs can be made extremely brief (in effect, a few minutes), which represents an enormous advantage when one considers that conventional machines require some two or three hours to set up between jobs.

With operation resumed, the left hand bay 9*a* can be vacated by removing the trolley 4*a*, and with it the relative cylinder 6*a*, and a replacement cylinder brought in for the next run.

Compared to a conventional machine, the machine described involves a marginally higher cost in terms of initial outlay, given that the second bay of each station must be equipped with the second impression cylinder and ancillary devices, and with the second doctor. Nonetheless, the cost of these extra components is negligible when set against the overall purchase price of the machine, and will be absorbed within a significantly short space of time given the great savings obtainable as a result of the drastic reduction in down time between jobs. In essence, utilizing the selfsame structures as those found in a conventional rotary machine, i.e. the same reel-feed arrangement for the web, the same gantry type structure for the support of the cylinders and the same ink drying systems, and with a modest additional outlay in respect of a second impression cylinder and doctor installed at each print station, one has two separate rotary machines operating in alternation; in terms of results, this signifies an increase in the output obtainable from the rotary machine, bought at a cost which will be seen to be negligible in comparison to the purchase price of a complete second machine. What is more, the improved machine can be exploited profitably even with frequent changes of the print cylinders, and is therefore suitable for typical jobbing work never permissible hitherto with conventional rotary machines for reasons of cost.

We claim:

1. A print station for a rotary gravure printing machine, the print station comprising:

means defining a first bay and a second bay, the first and second bays being symmetrically disposed adjacent to each other;

a first print cylinder, the first print cylinder being received by the first bay and being removable therefrom;

a second print cylinder, the second print cylinder being received by the second bay and being removable therefrom;

a first impression cylinder, the first impression cylinder being situated adjacent to the first bay;

a second impression cylinder, the second impression cylinder being situated adjacent to the second bay;

a web;

means for moving said first and second impression cylinders between a first position wherein said first impression cylinder adjoins said first print cylinder and said second impression cylinder is spaced apart from said second print cylinder and a second position wherein said first impression cylinder is spaced apart from said first print cylinder and said second impression cylinder adjoins said second print cylinder, said first impression and print cylinders being operative with respect to said web while said first and second impression cylinders are in said first position, said second impression and print cylinders being operative with respect to said web while said first and second impression cylinders are in said second position;

a first doctor for removing surplus ink from the first print cylinder, the first doctor being positioned adjacent to the first bay;

a second doctor for removing surplus ink from the second print cylinder, the second doctor being positioned adjacent to the second bay;

means for guiding said web through said first and second bays, said means for guiding including means for causing said web to travel through a first web route and means for altering the route of travel of said web such that said web is caused to pass through a second web route of travel, the first web route of travel being defined between the first impression cylinder and the first print cylinder when the first and second impression cylinders are in the first position, and the second web route of travel being defined between the second impression cylinder and the second print cylinder when the first and second impression cylinders are in the second position;

said means defining said first and second bays being configured and said means for guiding said web being arranged such that the first impression and print cylinders can engage said web and cause said web to travel along said first web route while the second print cylinder is removed from said second bay or while said first and second impression cylinders are in said first position, and said second impression and print cylinders can engage said web and cause said web to travel along said second web route while said first print cylinder is removed from said first bay or while said first and second impression cylinders are in said second position.

2. A print station as defined by claim 1, wherein the first and the second bays, the first and second impression cylinders, and the first and second print rollers are symmetrically disposed on either side of a vertical median plane passing through the print station.

3. A print station as defined by claim 1 including first and second trolleys, the first and second print cylinders being mounted respectively on the first and second trolleys.

* * * * *